US008141979B2

(12) United States Patent
Shibata et al.

(10) Patent No.: US 8,141,979 B2
(45) Date of Patent: Mar. 27, 2012

(54) INK JET RECORDING HEAD AND METHOD FOR MANUFACTURING INK JET RECORDING HEAD

(75) Inventors: Takeshi Shibata, Yokohama (JP); Hiroyuki Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 438 days.

(21) Appl. No.: 12/372,842

(22) Filed: Feb. 18, 2009

(65) Prior Publication Data

US 2009/0213169 A1 Aug. 27, 2009

(30) Foreign Application Priority Data

Feb. 27, 2008 (JP) ..... 2008-046252

(51) Int. Cl.
*B41J 2/165* (2006.01)

(52) U.S. Cl. ..... 347/29

(58) Field of Classification Search ..... 347/20, 347/22, 29, 50
See application file for complete search history.

(56) References Cited

U.S. PATENT DOCUMENTS

| | | | |
|---|---|---|---|
| 6,652,702 | B2 | 11/2003 | Miyazaki et al. |
| 6,799,831 | B2 | 10/2004 | Inamoto et al. |
| 2007/0285465 | A1 | 12/2007 | Shibata et al. |

FOREIGN PATENT DOCUMENTS

| | | |
|---|---|---|
| JP | 2002-154209 | 5/2002 |

*Primary Examiner* — An Do
(74) *Attorney, Agent, or Firm* — Fitzpatick, Cella, Harper & Scinto

(57) ABSTRACT

A manufacturing method for an ink jet recording head including the steps of preparing a recording element substrate provided with an ejection outlet array for ejecting ink; preparing a supporting member, provided with a plurality of ink supply passages, for supporting the recording element substrate; and connecting the recording element substrate to the supporting member with an adhesive material. The supporting member has an adhesive material application region surrounding adjacent ink supply passages, and a part of the adhesive material application region which extends along the ejection outlet array has a width larger than another part of the adhesive material application region.

9 Claims, 5 Drawing Sheets

INK JET RECORDING HEAD AND METHOD FOR MANUFACTURING INK JET RECORDING HEAD

FIELD OF THE INVENTION AND RELATED ART

The present invention relates to an ink jet recording head used for such a recording apparatus that forms images by jetting recording liquid, such as ink, in the form of a droplet from its liquid jetting holes. It also relates to a method for manufacturing an ink jet recording head.

An ink jet recording apparatus is a recording apparatus which uses a so-called nonimpact recording method. Thus, it is characterized in that not only does it make virtually no noise when it is recording, but also, it is capable of recording on a variety of recording media at a high speed. Because of these characteristics, an ink jet recording apparatus is widely used as a part of the recording mechanism of a printer, a copying machine, a facsimile machine, wordprocessor, or the like.

The typical ink jetting methods used by a recording head mounted in an ink jet recording apparatus, such as those mentioned above, are as follows. One of them is the method which uses an electro-mechanical transducer, such as a piezoelectric element. Another one is the method which heats ink by irradiating ink with electromagnetic waves, such as laser light, to jet ink droplets. Also known is an ink jetting method which heats ink with the use of an electrothermal transducer, such as a heat generating resistor, to cause the ink to boil in the manner of so-called film boiling so that the ink is jetted by the pressure generated by the boiling of the ink, that is, the growth of a bubble in the ink.

Among the various ink jet recording heads mentioned above, there is the ink jet recording head which uses electrothermal transducers and records images by jetting ink onto a recording medium. More specifically, the ink jet recording head is provided with recording liquid chambers, in which an electrothermal transducer is disposed. In operation, recording signals, which are in the form of an electrical pulse, are sent to the electrothermal transducer. As the electrothermal transducer receives recording signals, it generates heat (thermal energy), causing the ink in the recording liquid chamber to boil (changes in phase); it generates a bubble (bubbles) in the ink in the recording liquid chamber. As the bubble grows, it increases the pressure in the recording liquid chamber. As a result, the ink is jetted out of the microscopic outlet (nozzle), onto recording medium, forming an image on the recording medium. That is, an ink jet recording head which uses electrothermal transducers has: nozzles, one end of which opens outwardly; ink passages through which the nozzles are supplied with ink; and a common liquid (ink) chamber (or chambers), from which ink is delivered to each of the nozzles.

Further, some ink jet recording heads are structured so that their ink containers are separable from their ink jet recording head portions, whereas others are structured so that their ink jet containers are not separable from their ink jet recording head portions.

Next, referring to FIG. 10, a typical conventional ink jet recording head cartridge will be described.

The ink jet cartridge which will be described next is a color ink jet cartridge which prints images by jetting yellow, magenta, and cyan inks.

First, referring to FIGS. 10 and 11, the adhesive application areas of the recording chip supporting member (which hereafter will be referred to simply as supporting member) of the conventional ink jet recording head, and its adjacencies, will be described regarding their general structure. The adhesive application area surrounds the opening of each of the common (main) ink delivery passages of the ink jet recording cartridge, which is on the recording chip side.

FIG. 11 is an enlarged sectional view of the supporting member 801 of the ink jet recording head portion, and the bodies of adhesives 805 on the supporting member 801, at a line C-C in FIG. 10. The supporting member 801 is a part of the ink jet head cartridge, which has common ink passages 802 for delivering ink to the recording chip bonded to the supporting member of the ink container. The supporting member 801 is formed of alumina or the like substance, and has been polished so that the recording chip can be accurately adhered thereto. The recording chip is firmly bonded to the supporting member 801 with the use of an adhesive 805. The adhesive application area 803 is where the adhesive 805 is applied to firmly bond the recording chip to the supporting member 801 while keeping the adjacent two common ink passages 802 perfectly separated from each other to prevent the ink in one common ink passage 802 and the ink in the other common ink passage 802 from mixing in the ink jet recording cartridge.

There are also supporting members 801 formed of a resinous substance. A supporting member 801 formed of a resinous substance is lower in the positional accuracy with which the recording chip can be bonded to the supporting member 801 than a supporting member 801 formed of alumina or the like. However, it is advantageous in that it can be less expensively manufactured than a supporting member 801 formed of alumina or the like.

As the adhesive for bonding the recording chip to the supporting member 801, it is common practice to use one of the adhesives which are curable with ultraviolet rays and heat, because they are easy to handle in the bonding step in the manufacture of an ink jet recording head portion.

In the case of an ink jet recording head portion which is in accordance with the invention disclosed in Japanese Laid-open patent Application 2002-154209, each of the partitioning walls of the supporting member, which keeps the adjacent two common liquid passages from each other, is thicker than the distance between the openings of the adjacent two common liquid passages. This structural arrangement does not require the positional accuracy with which the adhesive is applied to the partitioning walls of the supporting member, to be very high. Therefore, this structural arrangement makes it unnecessary for the recording chip to be positioned relative to the supporting member, with extremely high accuracy.

In recent years, ink jet recording heads have been continuously falling in price. In order to reduce an ink jet recording head in its manufacturing cost, it is required to manufacture an ink jet recording head without raising the accuracy with which a recording chip is positioned relative to the supporting member, and also, with the use of an inexpensive manufacturing apparatuses. However, relaxing the accuracy with which a recording chip is positioned relative to its supporting member is likely to cause the following problems.

That is, when the adhesive for bonding a recording chip to a supporting member was applied to the supporting member, the adhesive failed to land on the center of the adhesive application surface of the partitioning wall, in terms of the widthwise direction of the partitioning wall, and therefore, the body of the applied adhesive slumped into the adjacent common ink passage(s). This resulted in the problem that the ink in a given common ink passage and the ink in the adjacent common ink passage mixed with each other in the ink jet recording head. The results of the analysis of this problem revealed that in order to ensure that the adhesive accurately lands on the center of the adhesive application surface of the partitioning wall, in terms of the widthwise direction of the partitioning wall, in a manner of drawing a fine line on the adhesive application surface of the partitioning wall with the adhesive, the adhesive application needle has to be highly accurately positioned relative to the supporting member. More specifically, the amount of the positional deviation between the needle and supporting member had to be no more than ±50 μm.

Reducing an adhesive application needle in diameter allows the abovementioned positioning accuracy to be relaxed. However, reducing an adhesive application needle in diameter increases the needle in flow resistance. Thus, it reduces the amount by which adhesive can be squeezed out of the adhesive applicator per unit length of time. Therefore, it increases the amount of time necessary to coat each recording head with the adhesive. This increases the length of time necessary to coat each recording head with the adhesive, and also, complicates the manufacturing line, which results in reduction in the productivity of the manufacturing line, and also, results in increase in manufacturing cost.

SUMMARY OF THE INVENTION

The primary object of the present invention is to provide an ink jet recording head which does not suffer from the problems which a conventional ink jet recording head, that is, an ink jet recording head in accordance with the above described background technologies, suffers, and also, to provide a method for manufacturing the ink jet recording head which does not suffer from the problem which a conventional ink jet recording head suffers.

Another object of the present invention is to provide an ink jet recording head which is satisfactory and stable in print quality, and yet, is no lower in manufacturing efficiency and no higher in manufacturing cost than a conventional ink jet recording head.

The present invention relates to an ink jet recording head, which has a recording chip and its supporting member, and which is manufactured by coating the chip supporting surface of the supporting member with adhesive. It also relates to a method for manufacturing the ink jet recording head. According to the present invention made to achieve the objects described above, the adhesive application area of the recording chip supporting member of an ink jet recording cartridge is shaped so that it surrounds the common ink passages(s) of the supporting member, and also, so that one of the lengthwise end portions of each of the columnar portions of the adhesive application area is wider than the rest of the columnar portion.

Also according to the present invention, it is possible to provide an ink jet recording head which is satisfactory and stable in print quality, and yet, is no lower in manufacturing efficiency and no higher in manufacturing cost than a conventional ink jet recording head.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be described with reference to the appended drawings.

Embodiment 1

First, referring to FIGS. 1, 2, 3, and 4, the ink jet recording head in the first preferred embodiment of the present invention will be described regarding its structure.

Figure 2:
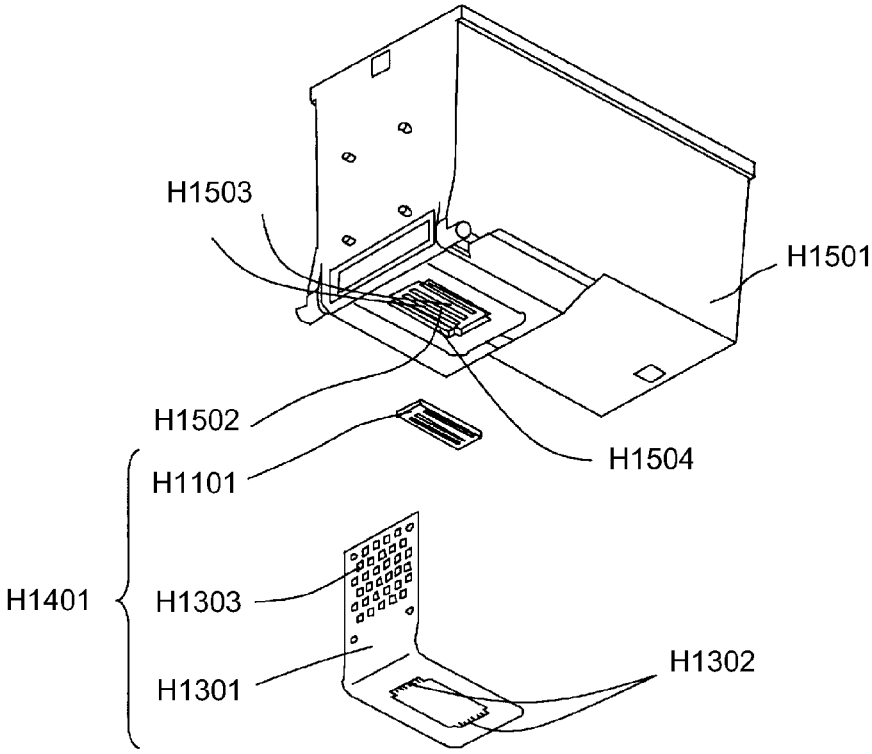
FIG. 2 is a partially exploded perspective view of the recording head cartridges, in the first and second preferred embodiments, which is for showing their structure.

FIG. 2 is a partially exploded perspective view of the ink jet recording head (which hereafter may be referred to as ink jet recording cartridge) in this embodiment, and shows the essential structural components of the ink jet recording cartridge. Essentially, the ink jet recording cartridge in this embodiment is made up of a recording chip H1101, a supporting member H1501, electrical wiring H1301, etc.

The recording chip H1101 is made up of a substrate formed of silicon, multiple energy generating elements (unshown) for jetting ink, electrical wiring (unshown) formed of aluminum or the like. The multiple energy generating elements and wiring are formed on one of the primary surfaces of the silicon substrate, with the use of a film formation technology. The silicon substrate is 0.62 mm in thickness.

Figure 4A:
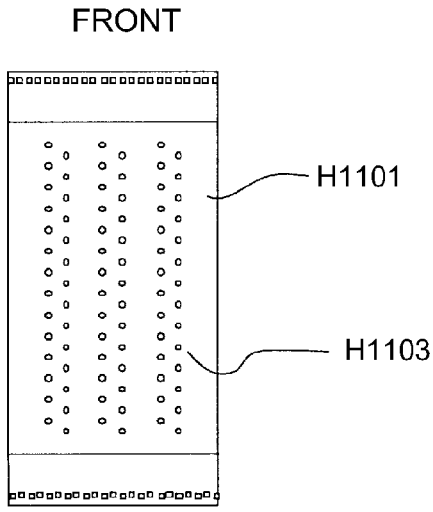
FIG. 4A is a rough plan view of the outward side, that is, the side having the ink jetting openings, of the recording chip in the preferred embodiments.
Figure 4B:
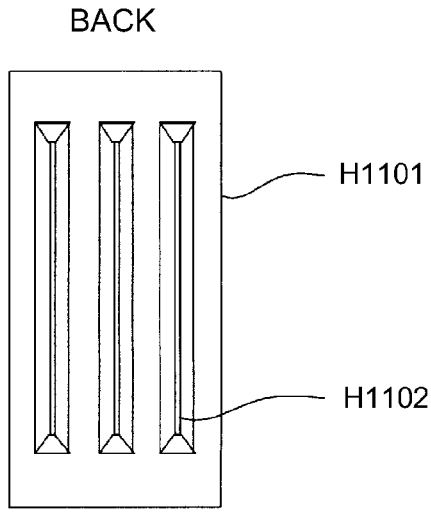
FIG. 4B is a rough plan view of the inward side, that is, the side having the common ink passages, of the recording chip.

Referring to FIGS. 4A and 4B, the recording chip H1101 has multiple energy generation elements (unshown), multiple ink passages (unshown), and multiple ink jetting holes H1103 (nozzles), which were formed with the use of the photolithography in such a manner that they correspond one for one. The recording chip H1101 has also multiple common ink passages for supplying the abovementioned multiple ink passages with ink. Each of the common ink passages is a through hole in terms of the thickness direction of the substrate of the recording chip; it is shaped so that its opposite opening from the multiple ink passages is at the opposite surface of the substrate from the multiple ink passages.

The electrical wiring board (plate) H1301 has a device hole (unshown), in which the recording chip H1101 fits. Further, the electrical wiring board H1301 has: electrical terminals which correspond to the electrodes (unshown) of the recording chip; and external signal input terminals H1303, through which the recording chip H1101 receives drive control signals from the main assembly of the printer. The external signal input terminals H1303 are in connection to the electrical terminals H1302 through the wiring formed of copper foil.

The supporting member H1501 is formed of a resinous substance by molding. In this embodiment, a resinous composite, which contains glass filler by 35% for rigidity, is used as the material for the supporting member H1501. This supporting member has ink delivery passages H1502, which are in connection to an ink storage portion (unshown). The recording chip supporting surface H1504 of the supporting member H1501 is provided with an adhesive application area H1503. In the case of the ink jet recording cartridge in this embodiment, the ink jet recording head is immovably attached to the ink container formed of a relatively inexpensive resinous substance. However, this embodiment is not intended to limit the present invention in scope. That is, the ink jet recording cartridge may be structured so that the ink container is separable from the ink jet recording head portion. Further, it may be formed of such a substance as aluminum.

Figure 1:
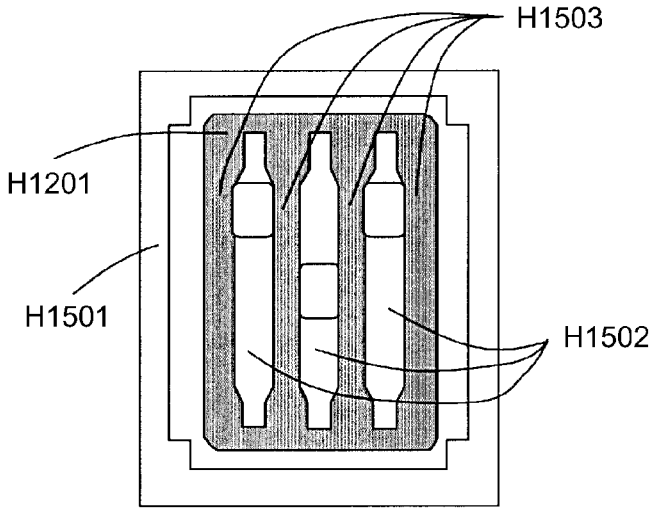
FIG. 1 is a plan view of the recording chip supporting member of the recording heads, in the first and second preferred embodiments of the present invention, which is for showing their structure.
Figure 3:
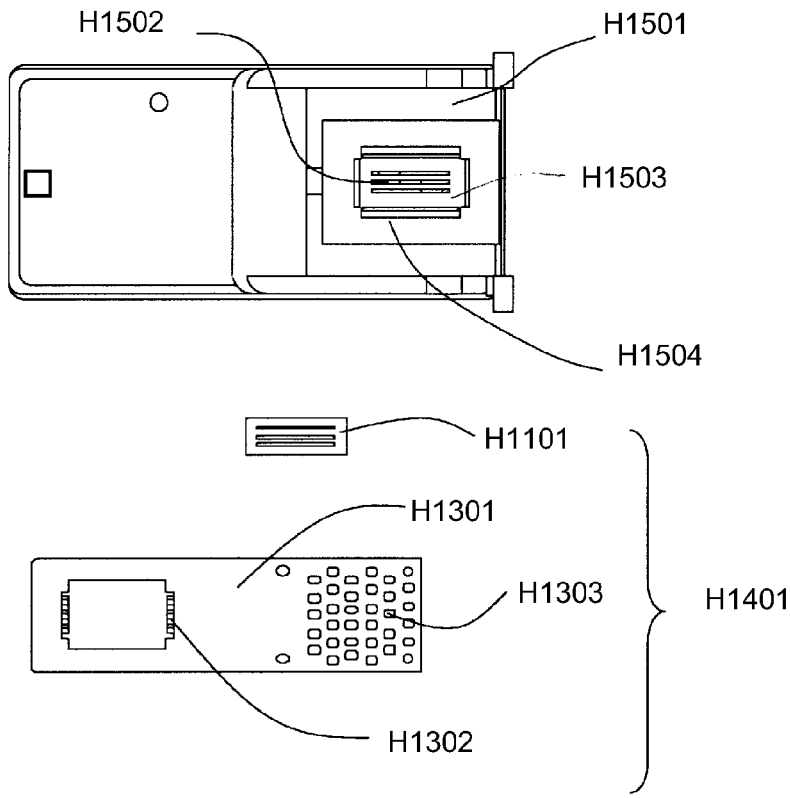
FIG. 3 is a plan view of the essential structural components of the recording cartridges in the first and second preferred embodiments.

FIG. 1 is a schematic plan view of the adhesive application area H1503 formed on the supporting member H1501 of the ink jet recording cartridge shown in FIGS. 2-4. A thermally curable adhesive H1201 used for bonding the recording chip H1101, shown in FIGS. 4A and 4B, to the supporting member H1501 is applied to the adhesive application area H1503. The supporting member H1501 is provided with multiple ink delivery passages, and is structured so that each of the portions of the adhesive application area H1503, which is between the adjacent two ink delivery passages H1502, is shaped so that it has a relatively wide portion (portions) and a relatively narrow portion.

Figure 5A:
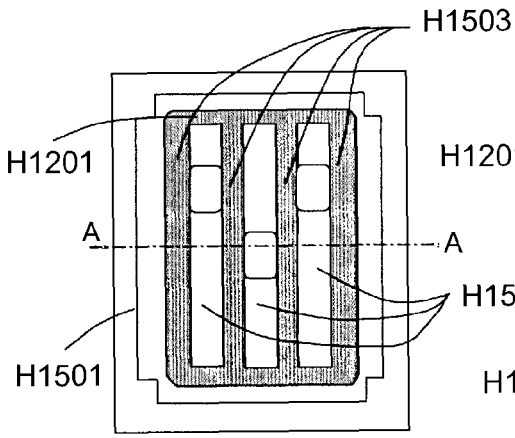
FIG. 5A is a plan view of the recording chip supporting member of a conventional ink jet recording cartridge as a comparative supporting member.
Figure 6A:
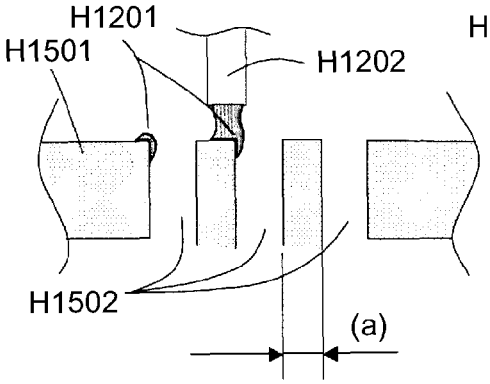
FIGS. 6A, 6B, and 6C are sectional views of the interface portion between the recording chip and supporting member of the ink jet recording cartridge in the first preferred embodiment, which are for describing the state of the adhesive H1201 after the application of the adhesive H1201 to the adhesive application area H1503.
Figure 6B:
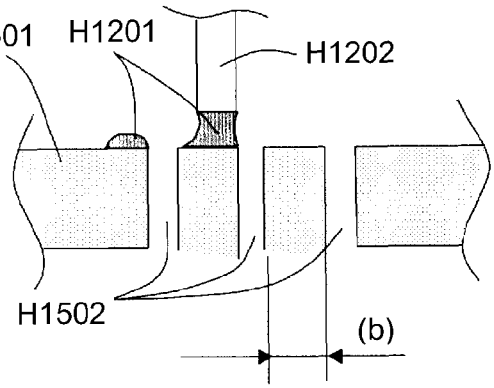

First, referring to FIGS. 5A and 6A, the adhesive application area H1503 of the supporting member of a comparative ink jet recording cartridge, that is, an ink jet recording cartridge in accordance with the prior art, will be roughly described regarding its shape.

FIG. 6A is a sectional view of the supporting member H1501 of the conventional ink jet recording cartridge, bodies of the applied adhesive H1201, and adhesive application needles, at the line A-A in FIG. 5A. In the case of this supporting member H1501, each of the columnar portions (a) of the adhesive application area H1503, shown in FIG. 6A, is 0.4 mm in width. The needle H1202 used for the adhesive application is 0.52 mm in internal diameter. First, the supporting member H1501 is firmly attached to a manufacturing apparatus so that it is precisely positioned relative to the apparatus. In this step, it is possible that there may occur a positional deviation of 20-100 μm between the supporting member H1501 and needle H1202. Then, the adhesive application needle H1202 is moved to its application start position, which corresponds to the adhesive application start point on the adhesive application area H1503. Since there may be a positional deviation 20~100 μm between the supporting member and manufacturing apparatus as described above, there may be the same amount (20-100 μm) of positional deviation between the actual adhesive application start position of the needle H1202 and the center of the adhesive application start point of each of the columnar portions of the adhesive application area H1503. It became evident that if the amount of the positional deviation between the supporting member H1501 and needle H1202 is no less than 50 μm, the body of adhesive H1201 slumps into the ink delivery passage H1502 from the top surface of the adhesive application area H1503.

Figure 5B:
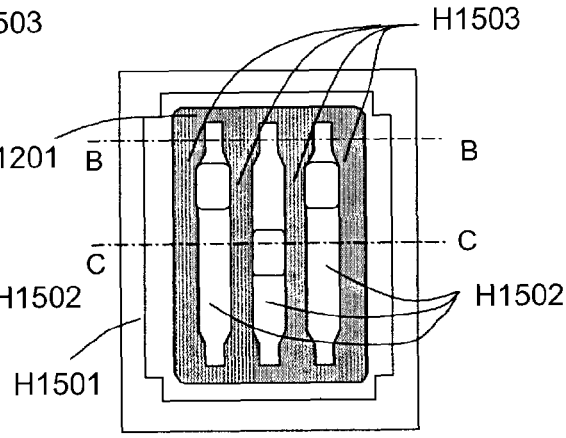
FIG. 5B is a plan view of the recording chip supporting member of the ink jet recording cartridge in the first and second preferred embodiments of the present invention.
Figure 6C:
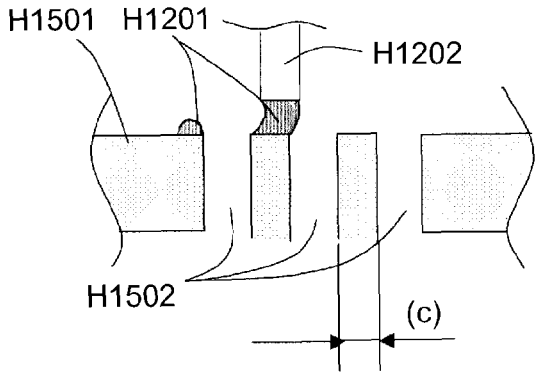

In this embodiment, therefore, the portion (b) of each of the columnar area (b) of the adhesive application area H1503 is widened to 0.6 mm, as shown in FIG. 6A, which is sectional view of the supporting member H1501, bodies of applied adhesive H1201, and adhesive application needle H1202 in this embodiment, at the line B-B in FIG. 5B. In other words, the portion (b), that is, one of the lengthwise end portions of each of the columnar portion of the adhesive application area H1503, was made 0.2 mm wider than the center portion of the columnar portion. Therefore, even if there is a positional deviation between the supporting member H1501 and needle H1202, the adhesive H1201 lands on the adhesive application area H1503, as long as the deviation is not excessive. In other words, the needle H1202 is made to begin its adhesive application when it is above the wider portion (b) of the columnar portion of the adhesive application area H1503, and then, is moved, in a manner of linearly scanning the columnar portion of the adhesive application area H1503, toward the lengthwise center portion (c) of the columnar portion, that is, the portion of the columnar portion, which is 0.4 mm in width, shown in FIG. 6C, which is a sectional view of the supporting member H1501, bodies of applied adhesive H1201, and adhesive application needle H1202 in this embodiment, at the line C-C in FIG. 5B. While the adhesive is applied to the narrow portion (c) of the columnar portion of the adhesive application area H1503, the viscousness of the adhesive H1201 functions to keep the body of the applied adhesive H1201 on the adhesive application area H1503; it prevents the body of the applied adhesive H1201 from slumping into the ink delivery passages H1502. Thus, even if there is positional deviation between the supporting member H1501 and needle H1202, it is possible to prevent the body of the applied adhesive H1201 from slumping into the ink delivery passages H1502, and therefore, it is possible to prevent the problem that the ink in a given ink delivery passage and the ink in the adjacent ink delivery passage(s) mix in the ink jet recording head, or to keep the problem suppressed to a level at which the mixture does not significantly affect the ink jet recording head in terms of image quality.

Figure 9:
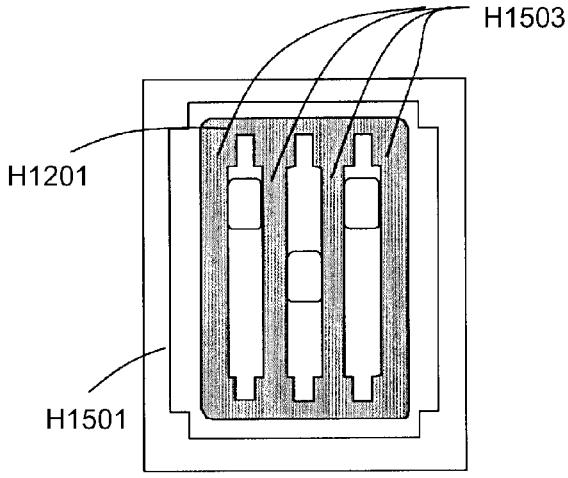
FIG. 9 is a schematic drawing of the supporting member of the ink jet recording cartridge in accordance with the present invention, which is for describing the adhesive application areas H1503 of the supporting member.
Figure 10:
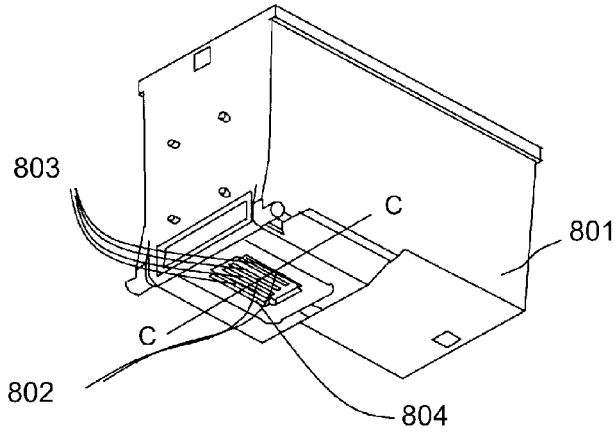
FIG. 10 is a schematic perspective drawing of a typical conventional ink jet recording cartridge.
Figure 11:
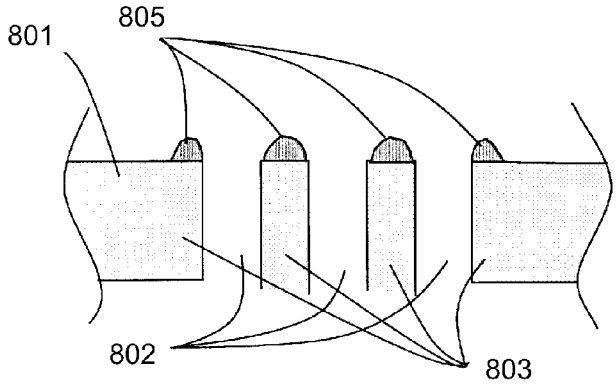
FIG. 11 is a sectional view of the recording chip supporting portion, and the bodies of adhesive applied to the supporting portion.

Further, shaping the adhesive application area H1503 as shown in FIG. 9 also can offer the same effect as that obtainable by this embodiment. More specifically, in the case of the adhesive application area H1503 shown in FIG. 9, the lengthwise end portions of each of its columnar portions, that is, the portions in the adjacencies of the adhesive application start point, are made relatively wide, and the application of the adhesive H1201 is started from one of the lengthwise ends of each of the columnar portions of the adhesive application area H1503, and then, is continued toward the lengthwise center portion of the columnar portion, which is relatively narrow. However, from the standpoint of ensuring that the body of the applied adhesive H1201 remains stable in shape, it is desired that the adhesive application area H1503 is shaped so that each of its columnar portions is widest at its lengthwise ends, that is, the portions in the adjacencies of the adhesive application start point, and gradually narrows toward its center portion, as shown in FIG. 5B.

Figure 8:
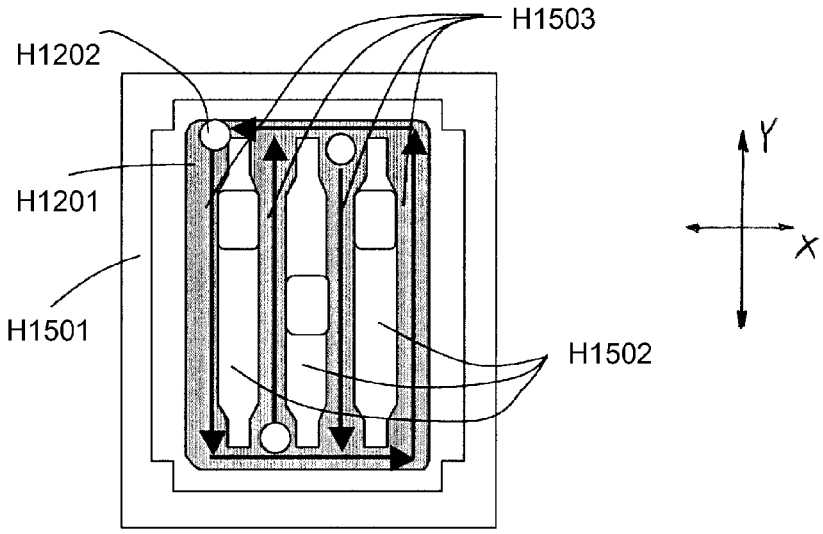
FIG. 8 is a plan view of the recording chip supporting member of the ink jet recording cartridge in the second preferred embodiment, which is for describing the ink jet recording head manufacturing methods in the first and second preferred embodiments.

Next, referring to FIG. 8, the method for applying the adhesive H1201 to the adhesive application area H1503 in a manner of drawing a fine line with the adhesive, with the use of a dispenser, will be described.

The level of viscosity of the adhesive H1201 is optional. That is, it may be selected as fits, as long as the body of the applied adhesive H1201 on the adhesive application area H1503 remains stable in shape. In this embodiment, an adhesive which is 14,000 mPa×s in viscosity, and 1.8 in thixotropic index was used as the adhesive H1201.

The adhesive H1201 is applied to the columnar portions of the adhesive application area H1503 and also, the rest of the adhesive application area H1503, with the adhesive application needle H1202. In a case where the direction in which the adhesive H1201 is applied to each of the columnar portions of the adhesive application area H1503 is parallel to the direction indicated by an arrow mark Y (which is parallel to direction in which ink jetting holes are aligned), the application is started at a point in one of the wide portions of each of the columnar portions of the adhesive application area H1503, and then, is continued in the direction parallel to the direction Y through the narrow portion of the columnar portion, and is ended in the other wide portion of the columnar portion, as shown in FIG. 8. Applying the adhesive H1201 in such a manner that the adhesive application needle 1202 starts moving above one of the wide portions, moves through the area above the narrow portion, and stops above the other wide portion (wide→narrow→wide) ensures that the adhesive H1201 is applied in such a manner that the body of the applied adhesive H1201 remains stable in shape. It should be noted here that the adhesive application area H1503 may be shaped so that only the lengthwise end portion of each of the columnar portions of the adhesive application area H1503, that is, the portion in which the adhesive application is started, is wide. However, shaping the adhesive application area H1503 as it is in this embodiment is advantageous in that even if the application direction has to be reversed due to the change in the manufacturing method, the adhesive application area H1503 does not need to be changed in shape.

As will be evident from the description of this embodiment given above, the present invention makes it possible to provide a reliable ink jet recording head without drastically improving in accuracy the apparatus for manufacturing an ink jet recording head.

The width of the columnar portions of the adhesive application area H1503 does not need to be limited to the value in this embodiment. That is, it has only to be determined according to the adhesive selection, needle size, manufacturing apparatus accuracy, amount by which the adhesive is applied, etc.

Embodiment 2

Next, referring to FIG. 7, the second preferred embodiment of the present invention will be described. Here, only the differences of this embodiment from the first embodiment will be described. In other words, the structural features of the ink jet recording head in this embodiment, which are not described, are the same as those in the first embodiment.

Figure 7A:
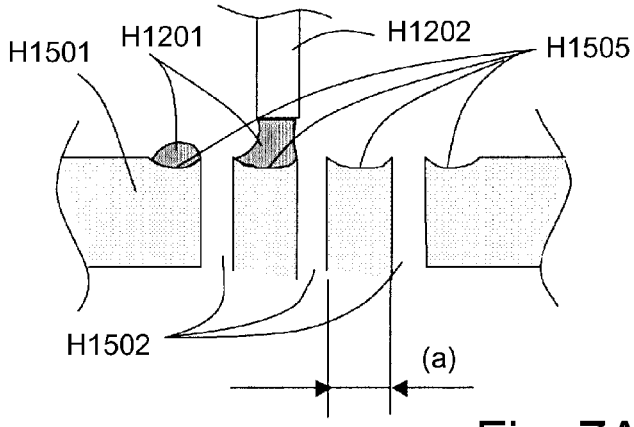
FIGS. 7A and 7B are sectional views of the interface portion between the recording chip and supporting member of the ink jet recording cartridge in the second preferred embodiment, which are for describing the state of the adhesive H1201 after the application of the adhesive H1201 to the adhesive application area H1503.
Figure 7B:
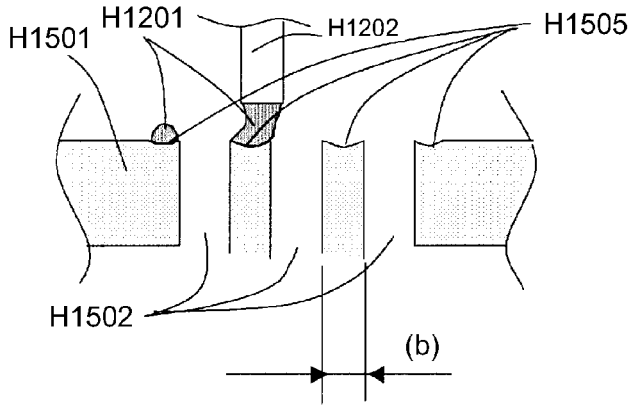

Referring to FIG. 7A, which corresponds to the line B-B in FIG. 5B, the supporting member H1501 may be shaped so that in terms of the cross section, the adhesive application area H1503 is concave. Also in this embodiment, the width of the lengthwise end portions (b) of each of the columnar portions of the adhesive application area H1503 was set to 0.6 mm, which was 0.2 mm wider than the lengthwise center portion (c) of each of the columnar portions of the adhesive application area H1503. Making the lengthwise end portions of each of the columnar portions of the adhesive application area H1503, that is, the portion in which the adhesive application is started, 0.2 mm wider than the lengthwise center portion (c) ensures that even if there is positional deviation between the supporting member H1501 and needle H1202, the adhesive H1201 lands on the adhesive application area H1503 unless the deviation is substantial. Thus, the adhesive application is started, with the needle H1202 positioned above the adhesive application start point of one of the lengthwise end portions of each of the columnar portions of the adhesive application area H1503, and then, is moved toward the lengthwise center portion of the columnar portion, which is narrower than the lengthwise end portions, in a manner to linearly scan the columnar portion. Even if the adhesive H1201 lands on the narrow (center) portions of the columnar portion slightly off the center thereof in terms of its widthwise direction, the viscousness of the adhesive H1201 virtually centers the body of the applied adhesive H1201. In addition, the concavities H1505 of the adhesive application area H1503 affect the bodies of the applied adhesive H1202 in such a manner that the highest point of each of the bodies of the applied adhesive H1201 shifts to the center of the columnar portion in terms of the widthwise direction of the columnar portion. Thus, the problem that the body of the applied adhesive H1201 slumps into the ink delivery passage(s) H1502 due to the positional deviation between the supporting member H1501 and needle H1202 does not occur. Therefore, the problem that the ink in a given ink delivery passage and the ink in the adjacent ink delivery passage(s) mix in the ink jet recording head does not occur, or remains suppressed below the level at which the mixture derogatorily affects the ink jet recording head in image quality. In other words, shaping the supporting member H1501 so that the cross section of the top surface of each of the columnar portions of the adhesive application area H1503 concaves ensures that after the application of the adhesive H1201 to the adhesive application area H1503, the bodies of the applied adhesive H1201 are retained in entirety by the adhesive application area H1503. That is, it does not occur that the adhesive H1201 slumps into the ink delivery passage (s) after its application to the adhesive application area H1503.

According to each of the above described preferred embodiments of the present invention, the supporting member H1501 is shaped so that at least one of the lengthwise end portion of each of the columnar portions of the adhesive application area H1503, more specifically, the lengthwise end portion in which the application of the adhesive H1201 to the adhesive application area H1503 in a manner of drawing a fine line on the adhesive application area H1503 with the adhesive H1201 is started, is wider than the other portion (lengthwise center portion) of the columnar portion.

Shaping the supporting member H1501 as described above makes it possible to compensate for the positional deviation of the body of the applied adhesive H1201, which is attributable to the inaccuracy with which the supporting member H1501 and needle H1202 are positioned relative to each other, without drastically improving in accuracy the apparatus for assembling an ink jet recording head. Therefore, it can prevent the problem that after the application of the adhesive H1201 to the adhesive application area H1503, the body of the applied adhesive H1201 slumps into the ink delivery passage(s) of the supporting member H1501. Therefore, it can prevent the problem that the ink in a given ink delivery passage H1502 and the ink in the adjacent ink delivery passage(s) H1502 mix in the ink jet recording head. Thus, it makes it possible to provide an ink jet recording head which does not suffer from the problem that an ink jet recording head prints unsatisfactory images due to the ink mixture which occurs in the ink jet recording head because of the mixture between the ink in a given ink delivery passage of the supporting member and the ink in the adjacent ink delivery passage(s) of the supporting member of the head. Further, shaping the supporting member H1501 as described above makes it possible to satisfactorily apply the adhesive H1201 without reducing the diameter of the needle H1202. Thus, it can prevent the problem that the productivity in the manufacturing of an ink jet recording head is reduced by the reduction in the diameter of the needle H1202.

As will be evident from the description of the preferred embodiments of the present invention given above, the present invention can provide an ink jet recording head which is satisfactory and stable in image quality, and yet, inexpensive because it is simple in structure and low in manufacturing cost.

Further, not only is the present invention satisfactorily applicable to an ordinary printing apparatus, but also, a copying machine, a facsimile machine, a wordprocessor having a printing portion, a multifunction recording apparatus made up of a combination of the preceding apparatuses, etc.

Further, an ink jet recording head in accordance with the present invention can be satisfactory mounted in a printer, a copying machine, a facsimile machine, a word processor having a printer portion, an industrial recording apparatus made up of a complex combination of the preceding apparatuses, etc.

The usage of an ink jet recording apparatus in accordance with the present invention makes it possible to record on such recording medium as paper, thread, fiber, leather, metal, plastic, glass, lumber, ceramic, etc. Incidentally, "recording" mentioned in the description of the preferred embodiments of the present invention given above means placing on recording medium, not only an image, such as a letter and a figure, that has a meaning, but also, a meaningless image such as a meaningless pattern.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 046252/2008 filed Feb. 27, 2008 which is hereby incorporated by reference.

What is claimed is:

1. A manufacturing method for an ink jet recording head comprising the steps of:

preparing a recording element substrate provided with an ejection outlet array for ejecting ink and a plurality of through-openings penetrating the recording element substrate to supply ink to the ejection outlet array;

preparing a supporting member, provided with a plurality of ink supply passages, for supporting the recording element substrate; and connecting the recording element substrate and the supporting member with each other with an adhesive material therebetween such that the through-openings and the ink supply passages are in fluid communication with each other, wherein at a side of the supporting member contacted by the adhesive material, a part of intervals between the ink supply passages is greater than another part of the intervals.

2. A method according to claim 1, wherein an application of the adhesive material starts at the part of the intervals with a greater dimension.

3. A method according to claim 1, wherein a part of a partition for separating the ink supply passages from each other in a region where the adhesive material is provided is larger than another part of the partition.

4. A method according to claim 1, wherein a region where the adhesive material is provided has a channel-like cross-section.

5. An ink jet recording head comprising:

a recording element substrate provided with an ejection outlet array for ejecting ink and a plurality of through-openings penetrating said element substrate to supply ink to the ejection outlet array;

a supporting member, provided with a plurality of ink supply passages in fluid communication with the through-openings, for supporting said recording element substrate, wherein said recording element substrate and said supporting member are connected with an adhesive material, wherein at a side of said supporting member contacted by the adhesive material, a part of intervals between the ink supply passages is greater than another part of the intervals.

6. An ink jet recording head according to claim 5, wherein an application of the adhesive material starts at the part of the intervals with a greater dimension.

7. An ink jet recording head according to claim 5, wherein a part of a partition for separating the ink supply passages from each other in a region where the adhesive material is provided is larger than another part of the partition.

8. An ink jet recording head according to claim 5, wherein a region where the adhesive material is provided has a channel-like cross-section.

9. A manufacturing method for an ink jet recording head comprising the steps of:

preparing a recording element substrate provided with an ejection outlet array for ejecting ink and a plurality of through-openings penetrating the recording element substrate to supply ink to the ejection outlet array;

preparing a supporting member, provided with a plurality of ink supply passages, for supporting the recording element substrate, wherein at a side supporting the recording element substrate, a region extending between the ink supply passages includes a relatively larger width region and a relatively smaller width region;

applying an adhesive material from the relatively larger width region toward the relatively smaller width region; and connecting the recording element substrate and the supporting member with each other with an adhesive material such that the through-openings and the ink supply passages are in fluid communication with each other.

* * * * *